United States Patent [19]

Exevea

[11] Patent Number: 4,508,518

[45] Date of Patent: Apr. 2, 1985

[54] TOY CAMERA THAT PRODUCES SIMULATED PHOTO

[76] Inventor: Amador G. Exevea, 6609 Thornberry Crescent, Windsor, Ontario, Canada, N8T 3A6

[21] Appl. No.: 336,508

[22] Filed: Dec. 31, 1981

[51] Int. Cl.[3] ..... A63H 33/30

[52] U.S. Cl. ..... 446/475; 446/485; 446/491; 101/269

[58] Field of Search ..... 46/1 R, 226, 228, 39; 101/269, 56; 446/475, 485, 491

[56] References Cited

U.S. PATENT DOCUMENTS

| | | | |
|---|---|---|---|
| 1,152,588 | 9/1915 | Wright | 101/56 |
| 1,305,807 | 6/1919 | Kerr | 446/490 |
| 1,609,899 | 12/1926 | Bigelow | 46/1 R |
| 1,703,346 | 2/1929 | Knorpp | 446/76 |
| 2,602,265 | 7/1952 | Jackson | 446/408 |
| 2,853,832 | 9/1958 | Arena | 46/228 |
| 2,935,939 | 5/1960 | Doherty et al. | 101/269 |
| 2,939,244 | 6/1960 | Grimes et al. | 446/408 |
| 3,090,158 | 5/1963 | Dixon | 446/485 |
| 4,244,137 | 1/1981 | Tseki | 446/475 |

*Primary Examiner*—F. Barry Shay

*Attorney, Agent, or Firm*—Albert O. Cota

[57] ABSTRACT

A toy camera with a housing cover containing an eye piece window for viewing and a flasher light with its accompanying release switch and safety switch. A battery energizes the light when the safety switch is closed and the release switch is depressed simulating a camera flash. A base partially enclosed within the housing contains a flexible plate having raised characters rolled on shafts disposed above a support board. A roll of paper and carbon paper are rotatably supported on the base and are positioned slidably over the plate and board. A spring loaded roller is pulled back and forth across the paper imprinting the ink from the carbon paper to the paper. The imprinted picture is manually pulled from the camera through a picture slot there it is torn off on serrated teeth. A crank arm allows the flexible plate to be directionally rolled exposing a new character on a blank frame or may be positioned over the board and a separate single plate inserted in the slot. Storage shelves provide a depository for the extra single plates and finished pictures. In another embodiment, the rolled paper is replaced with a stacked form of paper with carbon paper.

7 Claims, 12 Drawing Figures

TOY CAMERA THAT PRODUCES SIMULATED PHOTO

TECHNICAL FIELD

This invention relates to amusement devices having a self-contained voltage source in general and more specifically to an apparatus having imprinted picture making capabilities with an intermittent light source therein.

BACKGROUND ART

Toys in general are made to reproduce an item of interest to the child. Prior art has been limited to toy cameras that have the same basic shape and function, including a light simulating a flash. Other toys have simple lenses for viewing with static functions in place of actual picture reproduction using film as in an authentic camera. Toy cameras have been in long use having the basic shape with material possessing the exterior appendages reproduced on the surface with other colorful designs and indica resembling a camera, but not having any of the functional capabilities.

DISCLOSURE OF THE INVENTION

In order for a toy to have utility, it is necessary to simulate an object familiar to the child, although imagination may be exercized, the closer to reality the apparatus looks and feels, the more desirable it becomes. Dynamics included in the device further the desirability as a toy allowing the child to accomplish a task.

It is, therefore, the primary object of this invention to provide a toy that not only looks and feels like a camera, but produces an outlined image of a predetermined theme that could be construed in a childs mind as a photograph of a given subject like an actual camera. An important object includes the choice of electing a number of images that are preselected within the toy, each being designated with an identifying number. Further, the user may also choose a subject contained within a separate plate, introduced individually into the toy, to produce the desired image reproduction.

Another object allows the invention to produce a design or image on a precut paper that may be further utilized by the child to expand the design or figure with a pencil or pen and fill in with colored crayons, pencils, ink pens, or the like, allowing the user flexibility and creativity in the finished product.

Still another object provides a dynamic effect in the toys simulation of a camera by having a light instantaneously energized by a switch, not unlike the actual shutter release, simulating the flash of the camera.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
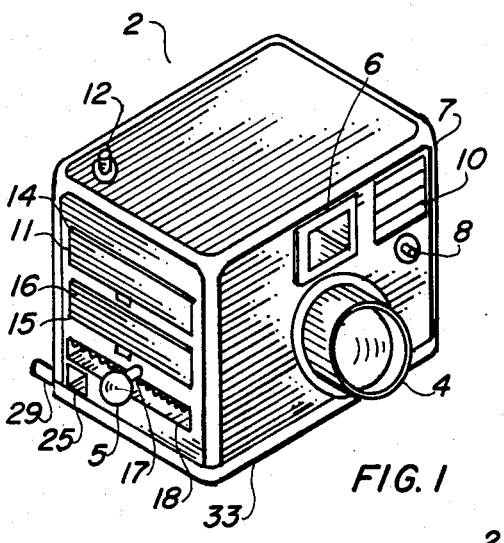
FIG. 1 is a partial isometric view of the preferred embodiment viewed from the front.
Figure 2:
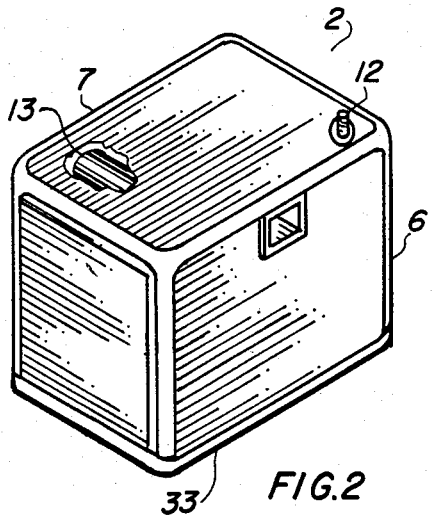
FIG. 2 is a partial isometric view of the preferred embodiment viewed from the rear.

Referring now to the referenced characters of the drawing, the invention in the preferred embodiment, best depicted in FIGS. 1–7, consists of a toy camera 2 having a cover 7 in the form of a housing with an open bottom. The cover 7 has the appearance of a real camera and contains an eye piece window 6 located near the top disposed the full width of the element with an opening therethrough for simulating the viewing lens of a camera. A raised appendage is located in the center front having the appearance of a lens 4, except no function is involved, other than the imitation of the component. The upper front corner contains a flasher light 10 that is recessed into the housing cover 7 and is preferably flush with the surface. A release button 12 is positioned on the top and comprises a single-pole, single-throw momentary switch. Integral with this switch 12 is a set of electrical contacts and a spring assembly 32, not shown, allowing the switch to maintain its normally open position until manually depressed. A flasher switch 8 having a single-pole contact arrangement is positioned in the front surface of the cover 7 and acts as a safety protection device to disengage the flasher light 10 from unwanted energization and electrical drain on the power source when not in actual use. A battery 13 is located within the housing 7 at the top corner and is accessible when the housing is removed.

Figure 11:
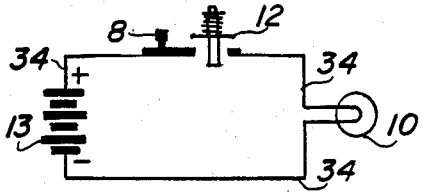
FIG. 11 is a schematic of the electrical circuit operating the light to simulate the flash.

FIG. 11 depicts the function of the above flasher light 10 system. The battery 13 may be of any convenient voltage, such as 1.5 volts Direct Current and is attached in a circuit with wire 34 to the various components providing the electrical power source. The positive side of the system is connected to the release button 12 providing a momentary electrical contact when manually depressed, closing the circuit which is connected mechanically to the flasher switch 8. This safety switch 8 is connected to the flasher light 10 and in turn to the negative side of the battery 13 closing the circuit.

A series of enclosed compartments are included with the housing cover 7 and consist of a picture shelf 14 including a door with a latch 11. This compartment is used to store completed pictures and is of the appropriate size for the function. The picture shelf 14 is located at the upper surface of the housing 7 and directly beneath is a plate shelf 16 of a similar nature also having a door with a plate shelf latch 15. Both doors on the shelves 14 and 16 hinge upwardly and the latches 11 and 15 interface with the housing 7 on the bottom. The plate shelf 16 is used to store separate plates that may accompany the device, as described later.

A picture slot 18 is directly below the previously described shelves and is horizontal in nature having a series of sharp saw type teeth on the upper surface that act to cut a paper picture when pulled up sharply in contact with the serrated surface.

A plate window 25 is positioned within the housing 7 on the lower side beneath the slot 18. This window 25 allows a visual indication of the picture producing mechanism, so as to determine the actual image to be reproduced. The housing cover 7 may be constructed of any material suitable for the application.

The picture producing apparatus housed within the cover 7 imparts an impression of a desired form to a paper placed thereupon. A flexible plate 26 is utilized that has each end secured to a rolled plate shaft 48 in scroll fashion, allowing the plate 26 to be rolled from one shaft 48 to the other and still retain the same relationship in center distance therebetween. The plate 26 has a raised character 23 portion on the top exposed surface that contains the image to be reproduced. This image may be of any nature, such as a figure, scene, cartoon character, or the like. Each image is separated by a space and a small character or number 35 corresponding to the surface exposed between the shafts 48 is positioned in such a manner as to be observed through the window 25. The flexible plate 26 is made of a resilient material, such as thermoplastic, synthetic rubber, or the like, having the characteristics of flexibility with sufficient resiliency to maintain the raised indica while being rolled between shafts 48. To augment this flexible plate 26, a secondary single plate 27 may be utilized simultaneously. This is accomplished by rolling the flexible plate 26 to a section having no raised portion at all and manually juxtaposing the single plate 27 thereupon. The characteristics of the material used in the single plate 27 is similar to the above, except it may have greater firmness and be self-supporting. The preferred embodiment includes both types of plates used together, however, either may be employed separately, as exactly the same function is accomplished. The single plate 27 is stored in the plate shelf 16 and is easily accessible through the door with the latch 15.

A base with a pair of support brackets 33 provide structural support for the picture producing means and is compressed of a rectangular flat platform with raised brackets on each side having holes and notches to receive the operational elements. This base support 33 is of a configuration to interface with the housing cover 7 and contains means to fasten the two components together. The support brackets of the base 33 are located on the longitudinal sides and have bores to receive the rolled plate shafts 48 in parallel relationship, thus providing rotational support for the flexible plate rolled between. Directly underneath the flexible plate 26 is a support board 30 providing a flat rigid surface upon which the flexible plate 26 may rest. This board 30 is secured to the base 33 and has sufficient structural integrity for the purpose.

In order to rotate the flexible plate 26, a crank arm 29 is connected to one of the shafts 48 and provides the motive force when manually manipulated in a rotational fashion. The crank arm 29 protrudes beyond the base 33 and a slot is provided in the housing 7 allowing removal of the housing without disturbing the crank arm 29. In order to reverse wind the flexible plate, a plate belt 28 is employed attaching the two shafts 48 together with a sheave 54 on each shaft. This belt 28 may be any style, flat, vee, cogged, round, or could be a chain with sprockets, as long as communication is achieved therebetween.

The picture from the camera is reproduced on sheet means, the preferred embodiment employing a strip of rolled carbon paper 31 wound upon a rolled form shaft 46 with one end contiguous with the shaft 46 and the other slideably positioned over the plate support board 30. The carbon paper 31 continues past the board 30 and protrudes through the picture slot 18 in the cover 7. Similarly, a strip of rolled paper 24 is positioned on top of the carbon paper 31 and parallels the movement being superposed thereon. The carbon paper shaft 46 is positioned in a pair of slots in the base brackets 33 adjacent to the flexible plate 26 and is free to rotate. The paper shaft 46 is likewise located within another set of slots in the base brackets 33 next to the carbon paper roll 31, allowing the paper 24 to rest upon the carbon paper roll 31 and continue in like manner to project beyond the cover 7. The carbon paper 30 contains a type of ink that is sensitive to pressure and functions to transmit the ink to another surface when pressure is externally applied.

Figure 3:
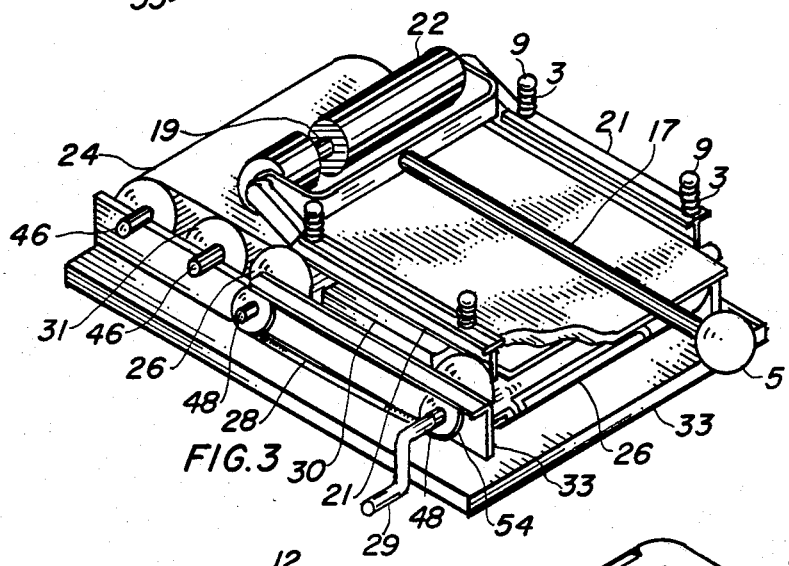
FIG. 3 is a partial isometric view of the preferred embodiment with the cover removed to expose the apparatus, including the roller assembly in its "at rest" position.
Figure 4:
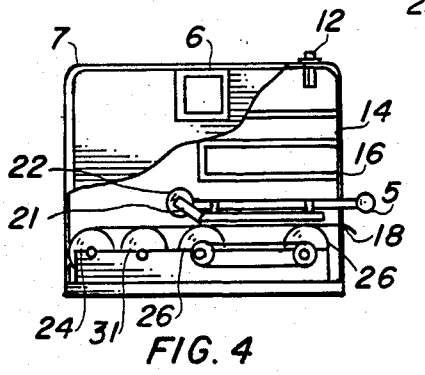
FIG. 4 is a rear view of the preferred embodiment partially cut-away to expose the elements therein, with the plate pressure puller in its full travel position and the paper and carbon paper distended beyond the device.
Figure 5:
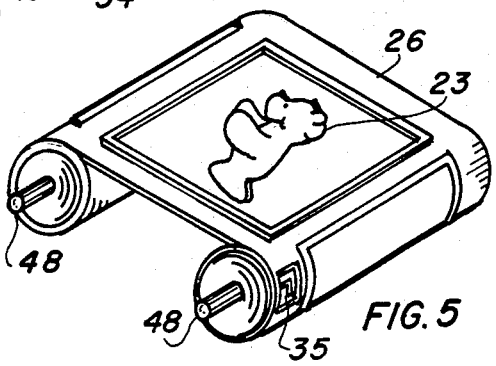
FIG. 5 is a partial isometric view of the rolled plate completely removed from the invention with the shafts in place.
Figure 6:
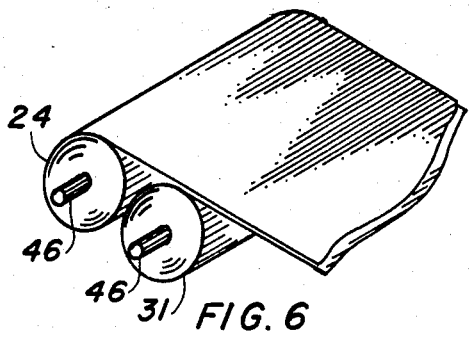
FIG. 6 is a partial isometric view of the rolled paper and rolled carbon paper in their approximate relationship removed from the toy camera for clarity.
Figure 7:
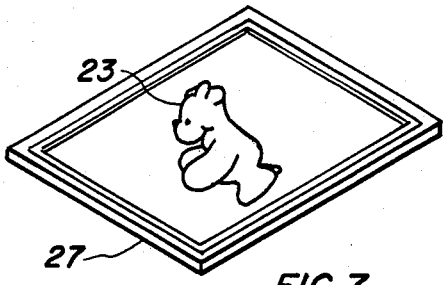
FIG. 7 is a partial isometric view of a single plate removed in its entirety from the apparatus.
Figure 8:
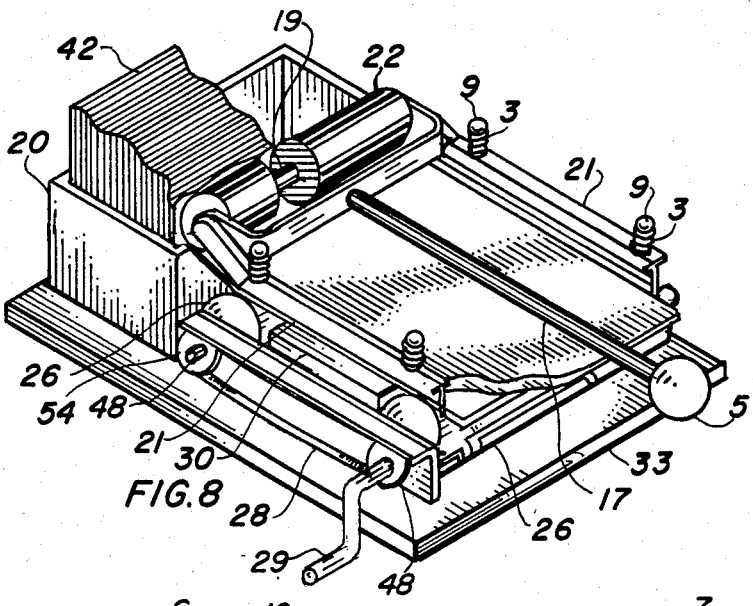
FIG. 8 is a partial isometric view of another embodiment with the cover removed to expose the apparatus, including the roller assembly, in the stacked paper form.

The pressure means is accomplished by the use of a roller 22 in cylindrical form having a roller shaft 19 through the central portion. A bifurcated puller arm 17 is attached on one end of the shaft 19 and contains a knob 5 at the extremity of the other for manual manipulation. The roller 22 is of a semirigid material on the outside and perhaps a harder substance on the inside, allowing the shaft to be grasped firmly, providing a bearing surface for the puller arm 17. A pair of grooved pressure bars 21 are disposed above and to the outside of the support board 30, which has the paper 24 and carbon paper 31 resting on the top. The pressure bar 21 is grooved on the sides facing each other forming a longitudinal cavity to receive each end of the roller bar shaft 19 creating a recessed slot, allowing the shaft 19 to be pulled throughout its length. The end of the pressure bar 21 above the rolled paper 24 and carbon paper 31, best illustrated in FIG. 3, is formed upward, allowing the enclosed roller 22 and shaft 19 to be maintained above the paper 24.

A plurality of spring loaded fasteners resiliently position the bars 21, so as to allow the roller 22 to be in contact with the paper 24 when pulled circularly within the grooves. The spring loaded fasteners consist of a pin 9 rigidly fastened to the base 33 through the pressure bar 21 with a spring 3 retained between the head of the pin 9 and the bar 21 urging the bar downward. When the puller arm 17 is extended away from the camera 2, the retained roller 22 is forced downward until it contacts the rigid plate support board 30 having the flexible plate 26, carbon paper 31 and rolled paper 24 layered on top of the board 30. The springs 3 apply pressure to the roller as it moves across the board 30 transferring the image 23 on the plate 26 to the paper 24 by the pressure sensitive nature of the carbon paper 31.

In operation the camera 2 is loaded by removing the cover 7 from the base 33 exposing the picture producing means and threading the carbon paper 31 under the roller 22 and on top of the board 30 and positioning the ends of the shafts in the grooves in the base brackets 33. Likewise, the rolled paper 24 is loaded in a similar manner with the end stopping even with the carbon paper 31. The cover 7 is replaced and the crank arm 29 is rotated until the desired raised character 23 is selected by observing the number or marking 35 through the window 25. The operator then simulates taking a picture by viewing through the eye piece window 6, depressing the release button 12 energizing the light 10. The camera 2 is then rotated and the arm 17 is pulled outward and inward with one motion using the knob 5 for a grip. The paper 24 and its accompanying carbon paper 31 are grasped on the end extending out of the picture slot 18 then lifted on the serrated teeth of the picture slot 18 and then torn off. The carbon paper 31 is then discarded. The image of the plate 26 or 27 appears on the paper 24 and the operator may then color in the design, or use it as a finished simulated photograph.

Figure 9:
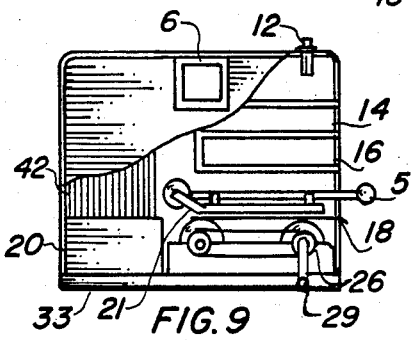
FIG. 9 is a rear view of the same embodiment, as FIG. 8, partially cut-away to expose the elements.
Figure 10:
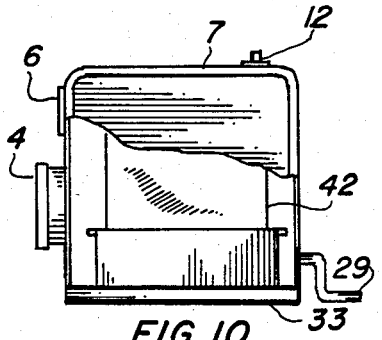
FIG. 10 is a side view of the apparatus, as above, showing the door and storage area for the stacked paper form.
Figure 12:
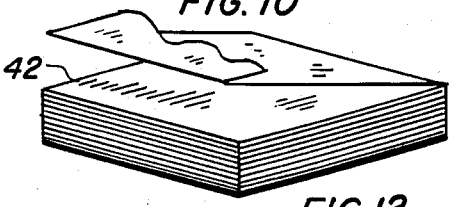
FIG. 12 is a partial isometric view of the paper and carbon paper in its stacked form removed from the device.

In another embodiment, illustrated in FIGS. 9, 10 and 12, the function of the apparatus is exactly the same as above, except the paper is in a different form. This embodiment employs the paper in a stacked form 42 with folds, instead of rolled on a shaft. The stacked form paper 42 includes separate carbon paper. In this configuration the paper 42 is housed vertically in a box-like stacked paper compartment 20 which holds the paper separately in the stack and allows one end to be threaded through the picture producing means in the same manner as the preferred embodiment. One large compartment 20 may be utilized, or it may be divided into two areas, one for storage and the other for operation.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

Having described the invention, what I claim is:

1. A toy camera including a simulated camera housing comprising:

a. picture-producing means in said housing including plate means for imparting an impression of a desired form, b. sheet means within said housing for receiving said impression, c. ink means within said housing for printing said impression, d. pressure means mounted in said housing for pressing said plate means and ink means against said sheet means, e. graspable means connected to said pressure means and extending outside said housing for manual operation of said pressure means, and, f. said housing including access means whereby said sheet means, after said impression has been received thereon may be removed from within said housing in a manner of a photograph being removed from a real camera.

2. The invention as recited in claim 1 wherein said picture-producing means further comprises: a flexible plate having raised indica on one side with each end rolled upon a pair of plate shafts with a crank attached thereto for imparting an image impression upon said sheet means when said pressure means are applied and repositioning new indica with said crank rolling said flexible sheet from one shaft to the other.

3. The invention as recited in claim 1 wherein said picture-producing means further comprises: a single plate having raised indica on one side for imparting an image impression upon said sheet means when said pressure means is applied, said single plate being stored within said housing and manually juxtapositioned with said pressure means for operation thereof.

4. The invention as recited in claim 1 wherein said sheet means further comprises: paper wound upon a rolled form shaft with one end contiguous with the shaft and the other slidably positioned between said plate means and said pressure means for receiving said image impression allowing separate images to be produced by manually pulling said paper from said camera sequentially.

5. The invention as recited in claim 1 wherein said sheet means and said ink means further comprise: folded paper having one side sensitized with ink with one end slidably positioned between said plate means and said pressure means for receiving said image impression allowing separate images to be produced by manually pulling said paper from said camera sequentially.

6. The invention as recited in claim 1 wherein said ink means further comprises: carbon paper wound upon a rolled form shaft with one end contiguous with the shaft and the other positioned between said sheet means and said picture producing means for transferring an image thereto.

7. The invention as recited in claim 1 wherein said pressure means and graspable means further comprise: a roller having a shaft therein with a bifurcated puller arm having a knob on one end for manual operation from outside of said camera housing.

* * * * *